US006829912B2

(12) United States Patent
Rempp et al.

(10) Patent No.: US 6,829,912 B2
(45) Date of Patent: Dec. 14, 2004

(54) METHOD FOR MAKING A TEXTILE WEB WITH A TUBULAR KNITTING REGION

(75) Inventors: Wolfgang Rempp, Gammertingen (DE); Otto Failenschmid, Gomaringen (DE)

(73) Assignee: H. Stoll GmbH & Co., Reutlingen (DE)

( * ) Notice: Subject to any disclaimer, the term of this patent is extended or adjusted under 35 U.S.C. 154(b) by 0 days.

(21) Appl. No.: 10/610,198

(22) Filed: Jun. 30, 2003

(65) Prior Publication Data

US 2004/0031293 A1 Feb. 19, 2004

(30) Foreign Application Priority Data

Jul. 3, 2002 (EP) ..... 02014676

(51) Int. Cl.[7] ..... D04B 7/04
(52) U.S. Cl. ..... 66/64; 66/170
(58) Field of Search ..... 66/172 R, 170, 66/177, 198, 60 R, 64, 183, 174

(56) References Cited

U.S. PATENT DOCUMENTS 500,269 A * 6/1893 O'Brien ..... 66/172 R
1,206,171 A * 11/1916 Thierdfielder ..... 66/172 R
5,890,381 A * 4/1999 Leeke et al. ..... 66/170
6,151,926 A * 11/2000 Leeke et al. ..... 66/170
6,401,496 B1 * 6/2002 Roell ..... 66/170

* cited by examiner

*Primary Examiner*—Danny Worrell
(74) *Attorney, Agent, or Firm*—Michael J. Striker

(57) ABSTRACT

A method for making a textile web with a base web and at least one tubular knitting region (21, 21', 23, 23') extending transversely to a knitting direction on a straight and circular knitter with at least two opposite needle beds includes making the tubular region(s) (21, 21', 23, 23') on a needle bed, whereby from a starting knitting row (15, 15'), a part of the needles (B, F, J, N, d, n, 1) respectively hold the knitting of the base web without knitting and with the other needles, knitting rows for making the tubular region according to the desired length are formed, before knitting is formed again in an ending knitting row (16, 16') of the tubular region with the needles (B, F, J, N, d, h, 1) holding the knitting of the base web. The free end of the tubular region is connected with the base web.

15 Claims, 4 Drawing Sheets

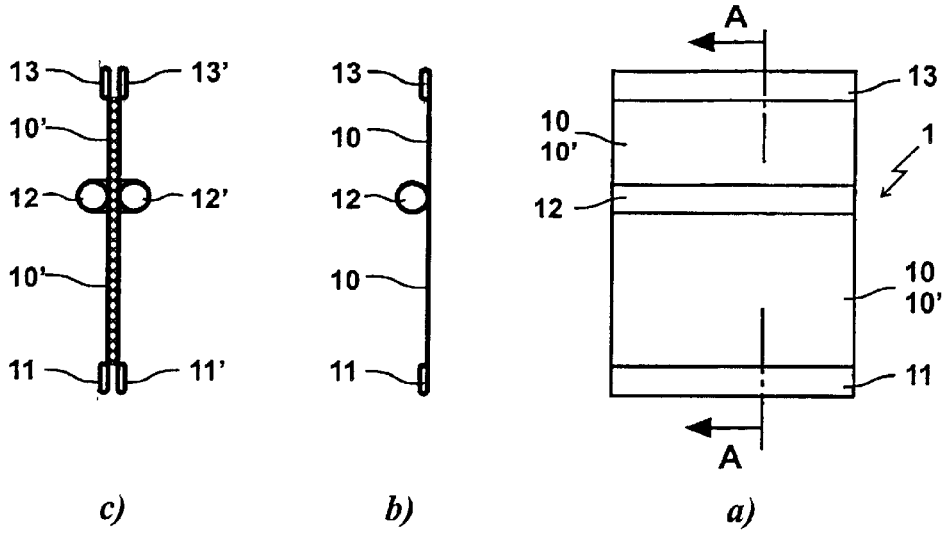
*Fig. 1*
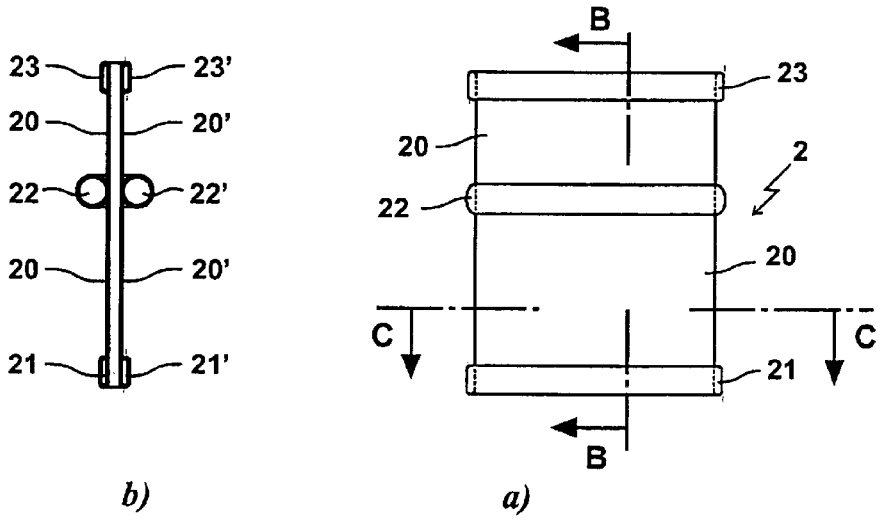
*Fig. 2*
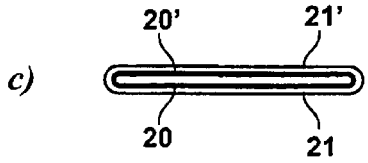

*a)*
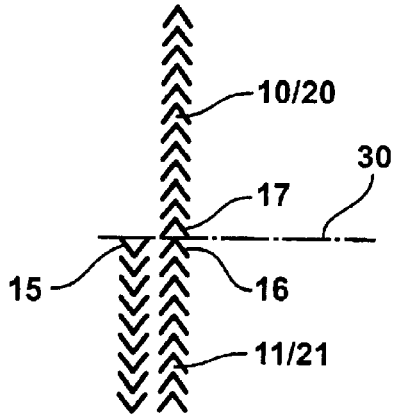
*Fig. 3* *b)*
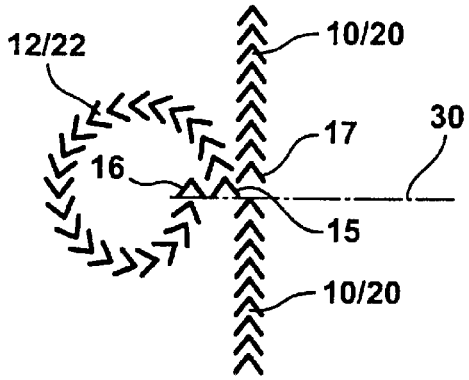
*c)*
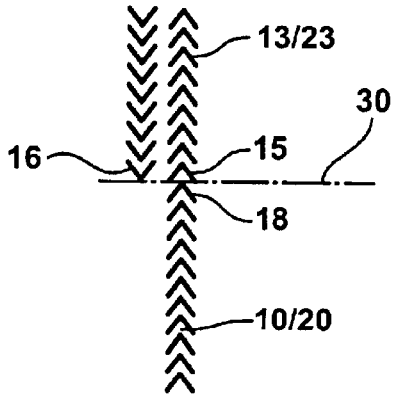

METHOD FOR MAKING A TEXTILE WEB WITH A TUBULAR KNITTING REGION

BACKGROUND OF THE INVENTION

The present invention relates to a method for making a textile web with a base web and at least one tubular knitting region extending transversely to a knitting direction on a straight and circular knitter with at least two opposite needle beds.

Such tubular knitting regions, until now, with one-bed or two-bed, area textile webs are formed in a manner, such that on both of the opposite needle beds, independent web paths are formed and these are consolidated again to one web path. With this method according to the state of the art, it is not possible to form a tubular knitting section with double-surface textile webs for each knitting plane.

Tubular knitting regions are provided in clothing articles, in particular, in the form of bands on the waistline and on leg or arm cuffs. These bands are made, such that on the leg or the waistband, knitted, U-shaped folded textile webs are sewed on. Another possibility is that one the arms or legs or in the waistband area, the textile web is formed to the doubled-band height and then the web is folded over to the band height, and the free foldover edges are sewed to the web. Both techniques used up to this point, then, require a sewing operation after making the textile web.

An object of the present invention is to make a textile web with tubular knitting sections without requiring a sewing operation.

This object is solved with a method of the above-described type, in which the tubular region(s) each are made on a needle bed, whereby from a starting knitting row, a part of the needles each hold knitting of the base web without knitting, and with the other needles, knitting rows for making the tubular region corresponding to the desired size are formed, before, in an ending knitting row of the tubular region, knitting is again formed with the needles holding the knitting of the base web, and whereby the free end of the tubular region is connected with the base web.

With this method, it is possible for the first time to make textile webs on a straight and circular knitter, in particular, articles of clothing with tubular sections at each desired region of the textile web, without having to perform a sewing operation. Thus, for example, pantyhose, including the elastic cuffs on the legs and the waistband, can be made completely on the machine. In this manner, it is possible to knit the band of the cuffs with all of the needles of a needle bed, whereby the desired high elasticity of the cuffs can be achieved.

The at least one tubular knitting region, therefore, can be formed in the same or different binding, with the same or different knitting threads, with the same or different strength, and in the same or different thickness as the base web. It is also possible to knit elastic threads, floating thread, or the like together with one another in the tubular region.

The textile web of the present invention has a base web and at least one tubular knitting region extending transversely to the knitting direction.

The base web, therefore, can be an areal, one bed web, an areal, double-bed, a spatial one-bed, or a spatial, two-bed web. The textile web can have at least one tubular knitting region on one or both web sides.

Thus, it is possible to provide a tubular knitting region at the beginning and/or on the end and/or at any position between the beginning or end of the base web. Therefore, then, not only waistbands or arm and leg cuffs can be made, but also tubular sections as parts of the fabric pattern of an article of clothing. If the textile web operates as a technical web, then, for example, tubular regions can be formed as attachment elements of the web to a tubular frame of the like.

In this manner, at least one tubular knitting region can be made in any knitting binding, with any strength, in any knitting volume, and with any knitting thread.

In addition, the at least one tubular knitting region can extend over the entire width, or the entire length, or only over a part of the width or length, of the base web.

Further advantages are provided if at least one tubular knitting region varies over its length in size. In this regard, in particular, style-related or also technical affects can be achieved.

In addition, it is also possible that the at least one tubular region is not closed sectionally, that is, that it is not connected with its free end completely with the base web. This is particularly an advantage with technical webs, since then the possibility of laterally inserting objects into the tubular region is provided.

A classical textile web piece according to the present invention is certainly an article of clothing, in which the at least one tubular region forms a band of the web. The invention, however, is not limited to this feature. If the tubular region is a band, then the foldover edge can be formed by means of a knitting row in a corresponding binding, such that both band sides can be folded flatly and the visible edge is optically appealing.

The invention also relates to a textile web, which is made on a straight and circular knitter with more than two needle beds, which is characterized in that it has at last one double-surface, tubular region. By providing further needle beds, this is possible technically without further devices.

BRIEF DESCRIPTION OF THE DRAWINGS

FIGS. 1*a*–1*c* shows a plan view and sectional views of an areal textile web with multiple tubular regions;

FIGS. 2*a*–2*c* show a plan view and sectional views of a spatial web with multiple tubular sections;

FIGS. 3*a*–3*c* show principle illustrations of the making of tubular knitting regions at different points of the base web;

DETAILED DESCRIPTION OF THE PREFERRED EMBODIMENTS

Figure 4:
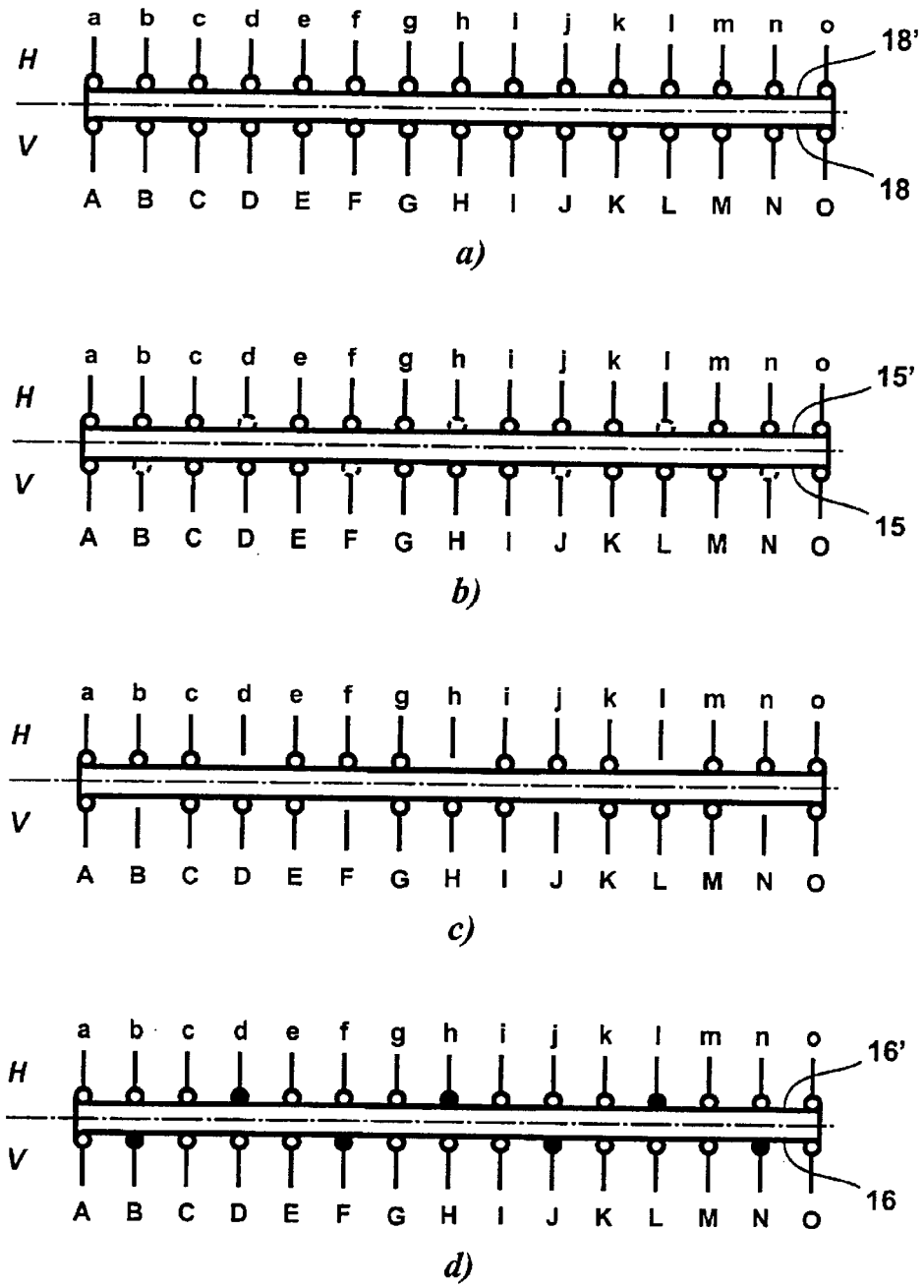
FIG. 4 shows a run of thread illustration of making a tubular knitting section on a base web.

FIG. 1*a* shows in a schematic representation a textile web 1 with an areal base web 10, 10', whereby the base web 10, 10' can be single-faced (FIG. 1*b*) or double-faced (FIG. 1*c*). On the base web 10, three tubular regions 11, 12, 13 are arranged.

As the sectional illustrations of FIGS. 1*b* and 1*c* show, the regions 11, 13 form cuffs on lower or upper ends of the textile web 1, while the tubular region 12 is arranged in a center region of the web 1. With the double-faced web 10' from FIG. 1*c*, also tubular regions 11', 12', 13' are arranged on the second base web side in a mirror image to the regions 11, 12, 13.

In FIG. 2, one example of a tubular web 2 with tubular regions 21, 22, 23 is shown. The tubular regions 21, 22, 23 are arranged on a base web 20, which has a front side 20 and a back side 20' (FIG. 2*b*). As the sectional illustrations in FIGS. 2*b* and 2*c* show, the tubular sections 21, 22, 23 extend seamlessly over the entire extent of the web 2. The regions 21, 23 are again cuffs at the beginning and on the end of the web 2. The region 22 is a tubular section in the center region of the web 2. By the tube-shaped structure of the web 2, the tubular regions 21, 22, 23 are formed on the front side 20 of the base web on the front needle bed and the tubular regions 21', 22', 23' are formed on the back side 20' of the base web on the rear needle bed.

With the webs 1 and 2 of FIGS. 1 and 2, the tubular regions 11, 12, 13, 11', 12, 13', and 21, 22, 23 run parallel to the base web side. This must not always be the case, however. They could also run at any angle to the base web side or to the knitting direction.

FIG. 3*a* shows schematically the making of the tubular regions 11, 21 at the beginning of the web 1, 2 from FIGS. 1 and 2. The starting knitting row 15 of the tubular region 11, 21 is simultaneously the starting knitting row for the entire textile web piece 1, 2. The tubular web 11, 21 ends with the ending knitting row 16. From the knitting row 17, then, the base web 10, 20 begins. The line 30 marks the interface between the band region 11, 21 and the base web 10, 20.

FIG. 3*b* shows the making of a tubular region 12, 22 at any point between the beginning and the end of the base web 10, 20. The base web 10, 20 is therefore knitted from under until reaching the line 30. Next, the tubular region 12, 22 is prepared beginning with the starting knitting row 15 to the ending knitting row 16. The ending knitting row 16 therefore serves as the connection of the tubular region 12, 122 to the base web 10, 20, which is continued from the row 17, then, again areally.

FIG. 3*c* schematically describes the making of an upper terminating band on the base web 10, 20. The last row of the base web 10, 20 is designated with reference numeral 18. From knitting row 15, the formation of the band 13, 23 begins, which again ends with the knitting row 16, in which the connection to the base web 10, 20 takes place.

FIG. 4 shows by way of example the knitting course for making a tubular knitting sections. The knitting course relates to a tube-shaped, spatial web, such as the web 2 in FIG. 2. The base web is a flat web, which is formed with all needles of the corresponding section of the front and rear needle beds. Also, the tubular knitting section 22, 23 is a flat web in the illustrated example.

FIG. 4*a* shows the last knitting rows 18, 18' of the tube-shaped base web 20. The needles A to O of the front needle bed V form knitting of the last knitting row 18 on the front knitting bed and the needles a through o form knitting of the last knitting row 18' on the rear needle bed.

FIG. 4*b* shows the first knitting rows 15, 15' of the tubular knitting region 21, 22, 23 (FIG. 2). The designated knitting is therefore knitting which serves only for making the base web 20, not, however, for making the tubular regions 21, 22, 23. In the knitting rows 15, 15 'of the front and rear needle beds V, H, no knitting is formed with the needles B, F, J, N, and d, h, I. All other needles, however, form knitting, which can be seen in particular in FIG. 4*c*. The knitting process shown in FIG. 4*c* is repeated until the desired diameter of the tubular region is reached. Thereafter, knitting is formed with all needles in the terminating knitting rows 16, 16' shown in FIG. 4*d*, whereby the free end of the tubular region is connected with the base web 20. The connection takes place by means of the knitting B, F, J, N on the front needle bed V and by means of the knitting b, h, I on the rear needle bed H. It is logical to uniformly distribute this connection knitting over the length of the tube-shaped knitting region; however, this need not be the case unconditionally. If a large area of the connecting knitting remains omitted, then the tubular knitting region 21, 22, 3 is open at this position, which, for example, can be desired with technical webs for insertion of attachment elements therethrough.

Figure 5:
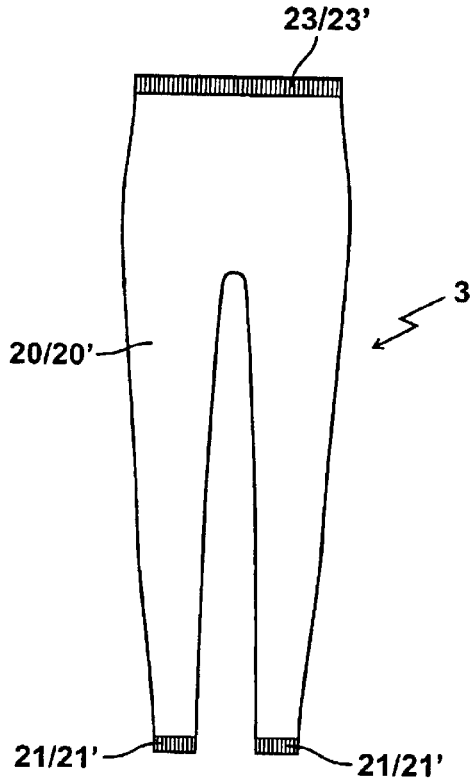
FIG. 5 shows a plan view of woven pants with tubular cuffs.
Figure 6:
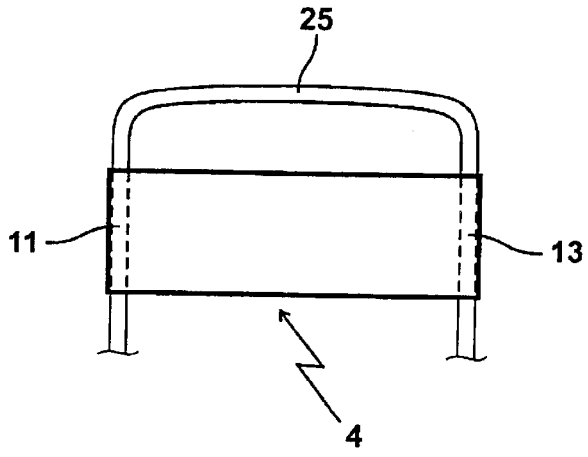
FIG. 6 shows a plan view of a chair back rest with tubular attachment regions.

FIGS. 5 and 6 show two possible knitting pieces, which can be formed as the knitting pieces of the present invention. In FIG. 5, knitted pants are shown, which are provided on the lower leg cuff and in the waistband, respectively, with a band 21, 21' and 23, 23'. The pants 3 are formed from a tube-shaped base web 20, 20' therebetween.

FIG. 6 shows the example of a knitted back rest 4, which is pulled over a frame 25. For receiving the frame bars, the web piece 4 has tubular regions 11, 13. The web piece 4 therefore is knitted beginning from the tubular side 11 to the tubular side 13.

It will be understood that each of the elements described above, or two or more together, may also find a useful application in other types of constructions differing from the types described above.

While the invention has been illustrated and described herein as a method for making a textile web with a tubular knitting region, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention,

What is claimed as new and desired to be protected by Letters Patent is set forth in the appended claims.

What is claimed is:

1. A method for making a textile web with a base web and at least one tubular knitting region extending transversely to a knitting direction on a flat knitting machine with at least two opposite needle bed, comprising the following steps:

making the at least one tubular knitting area on one of the needle beds, wherein from a starting knitting row, a first part of the needles of said one of the needle beds holds knitting of the base web without knitting and a second part of the needles of said one of the needle beds form knitting rows for making a tubular region according to a desired size, before, in an ending knitting row of the tubular region, knitting is again also formed with the first part of the needles holding the knitting of the base web, wherein whereby a free end of the tubular region is connected with the base web.

2. The method according to claim 1, wherein the at least one tubular knitting region is formed in shape selected from the group consisting of a same or in a different shape as the base web, wherein the at least one tubular knitting region is formed with a knitting thread selected from the group consisting of a same or different knitting thread as the knitting thread of the base web, and wherein the knitting thread of the at least one knitting region has a strength selected from the group consisting of a same or different strength as the strength of the base web, and wherein the knitting thread of the at least one tubular knitting region is selected from the group consisting of a same or different thickness as the knitting thread of the base web.

3. A textile web with a base web and at least one tubular knitting region extending transversely to a knitting direction, made according to the method of claim 1.

4. The textile web according to claim 3, wherein the base web is a flat, single-bed web.

5. The textile web according to claim 3, wherein the base web is a flat, double-bed web.

6. The textile web according to claim 3, wherein the base web is a spatial, single-bed web.

7. The textile web according to claim 3, wherein the base web is a spatial, double-bed web.

8. The textile web according to claim 3, wherein the textile web has at least one tubular knitting region on one or both knitting sides.

9. The textile web according to claim 3, wherein the textile web has a tubular knitting region at a beginning and/or on an end and/or at any position between the beginning or end of the base web.

10. The textile web according to claim 3, wherein the at least one tubular knitting region can be made in any knitting bond with any strength, in any knitting volume, and with any knitting thread.

11. The textile web according to claim 3, wherein the at least one tubular knitting region extends over an entire width or an entire length or only over a part of the width or length of the base web.

12. The textile web according to claim 3, wherein the at least one tubular knitting region varies over a length of the knitting region in size.

13. The textile web according to claim 3, wherein the at least one tubular knitting region is not closed sectionally, such that the at least one tubular region is not connected with its free ends over its entire length with the base web.

14. The textile web according to claim 3, wherein the at least one tubular knitting region forms a binding of the textile web.

15. A textile web with a base web and at least one tubular knitting region extending transversely to a knitting direction, made according to a method of claim 1 on a straight and circular knitter with more than two needle beds, wherein the textile web has at least one double-surface tubular region.

* * * * *